US006167848B1

(12) United States Patent
Frantzheld

(10) Patent No.: US 6,167,848 B1
(45) Date of Patent: Jan. 2, 2001

(54) WATER-COOLED INTERNAL COMBUSTION ENGINE

(75) Inventor: Gerolf Frantzheld, Aichwald (DE)

(73) Assignee: DaimlerChrysler AG, Stuttgart (DE)

( * ) Notice: Under 35 U.S.C. 154(b), the term of this patent shall be extended for 0 days.

(21) Appl. No.: 09/370,196

(22) Filed: Aug. 9, 1999

(30) Foreign Application Priority Data

Aug. 26, 1998 (DE) ..... 198 38 746

(51) Int. Cl.[7] ..... F02F 1/02
(52) U.S. Cl. ..... 123/41.79; 123/41.82 R
(58) Field of Search ..... 123/41.79, 41.72, 123/41.82 R, 41.84

(56) References Cited

U.S. PATENT DOCUMENTS 2,411,924 * 12/1946 Kratzer ..... 123/173
4,436,061 * 3/1984 Hayashi ..... 123/41.74
4,889,079 * 12/1989 Takeda et al. ..... 123/41.82
5,086,733 * 2/1992 Inoue et al. ..... 123/41.84
5,150,668 * 9/1992 Bock ..... 123/41.8
5,596,954 1/1997 Kennedy .

FOREIGN PATENT DOCUMENTS 197 39 165 3/1998 (DE) .
0 232 467 8/1987 (EP) .
3-117614 * 5/1991 (JP) ..... 123/41.82 R

* cited by examiner

*Primary Examiner*—Willis R. Wolfe
*Assistant Examiner*—Katrina B. Harris
(74) *Attorney, Agent, or Firm*—Klaus J. Bach

(57) ABSTRACT

In a water-cooled internal combustion engine with a cooling water path extending from a supply passage at one side of the engine through cooling water spaces around the engine cylinders to the cylinder head and back to a cooling water return channel at the other side of the engine, a separate annular cooling water channel extends around each cylinder adjacent the combustion chamber and this annular cooling channel is supplied by cooling water in a flow path parallel to the flow path through the cylinder head so as to provide for adequate cooling of the cylinders adjacent the combustion chambers.

8 Claims, 1 Drawing Sheet

WATER-COOLED INTERNAL COMBUSTION ENGINE

BACKGROUND OF THE INVENTION

The invention resides in a multi-cylinder water-cooled internal combustion engine with individual cylinder heads and individual cylinder sleeves and cooling water spaces formed around the cylinder sleeves to which cooling water is supplied by a supply passage supplying cooling water also to the cylinder head.

Such engines have been used in large numbers as Diesel drive units for commercial vehicles. However, further developments of such engines providing for increased power output causes increased thermal loads on such engines particularly if chargers are used to increase the engine power output. As a result, the engine may become thermally overloaded in critical areas. A particularly high thermal load occurs in the connecting areas between the cylinder head and the engine block, particularly the removable cylinder sleeves disposed in the engine block. At their ends adjacent the cylinder head, the cylinder sleeves have radially projecting shoulders which detrimentally affect the cooling of the top ends of the cylinder sleeves where they are subjected to the highest thermal load.

U.S. Pat. No. 5,596,954 discloses a water cooled Diesel engine, wherein the problem is addressed by providing, adjacent the shoulders of the cylinder sleeves, a narrow separate annular cooling water channel, which is in communication with the cooling water space around the cylinder sleeve by a communication passage formed in an annular flange defining the annular cooling water channel. To form the communication passage, the annular flange is cut tangentially on sides disposed opposite each other with resect to the direction of the longitudinal axis of the engine block, that is, adjacent the respective neighboring cylinder. The cooling water is supplied from the engine block to the cylinder head by supply passages which are disposed opposite each other with respect to the longitudinal axis of the engine block and which extend from an intermediate axial area of the cooling water space around the cylinder sleeves.

The annular cooling water channel is in communication with the supply passage by way of discharge bores so that the coolant can flow from the intermediate axial area of the cooling water space also through the annular cooling water channel to the supply passage. In order to obtain with such an arrangement sufficient coolant flow through the annular cooling water channel the cross-section of the opening leading to the supply passage is substantially smaller than the cross-section of the supply passage. As a result, the flow increase through the annular channel and the control of the cooling capability obtained thereby is quite limited.

SUMMARY OF THE INVENTION

In a water-cooled internal combustion engine with a cooling water path extending from a supply passage at one side of the engine through the cooling water spaces around the engine cylinder to the cylinder head and back to a cooling water return channel at the other side of the engine, a separate annular cooling water channel extends around each cylinder adjacent the combustion chamber and this annular cooling water channel is supplied by cooling water in a flow path parallel to the flow path through the cylinder head so as to provide for adequate cooling of the cylinders adjacent the combustion chambers.

With this arrangement, a pressure differential between the inlet to the annular channel and its outlet is generated by the pressure losses to which the cooling water is subjected in its passage through the cylinder head. This pressure differential is utilized to generate a fast cooling water flow through the annular channel around the cylinder sleeves adjacent the cylinder head as the annular channel forms essentially a throttled by-pass flow path parallel to the cooling water flow through the cylinder head. In this way, a high cooling capability is obtained if this is required. Also, a good control of the cooling water flow through the annular passage can be achieved with little efforts, for example, simply by an appropriate selection of the cross-section of the cooling water supply and/or discharge openings of the annular coolant channel.

The invention will become more readily apparent from the following description of a preferred embodiment thereof on the basis of the accompanying drawings.

DESCRIPTION OF PREFERRED EMBODIMENTS OF THE INVENTION

Figure 1:
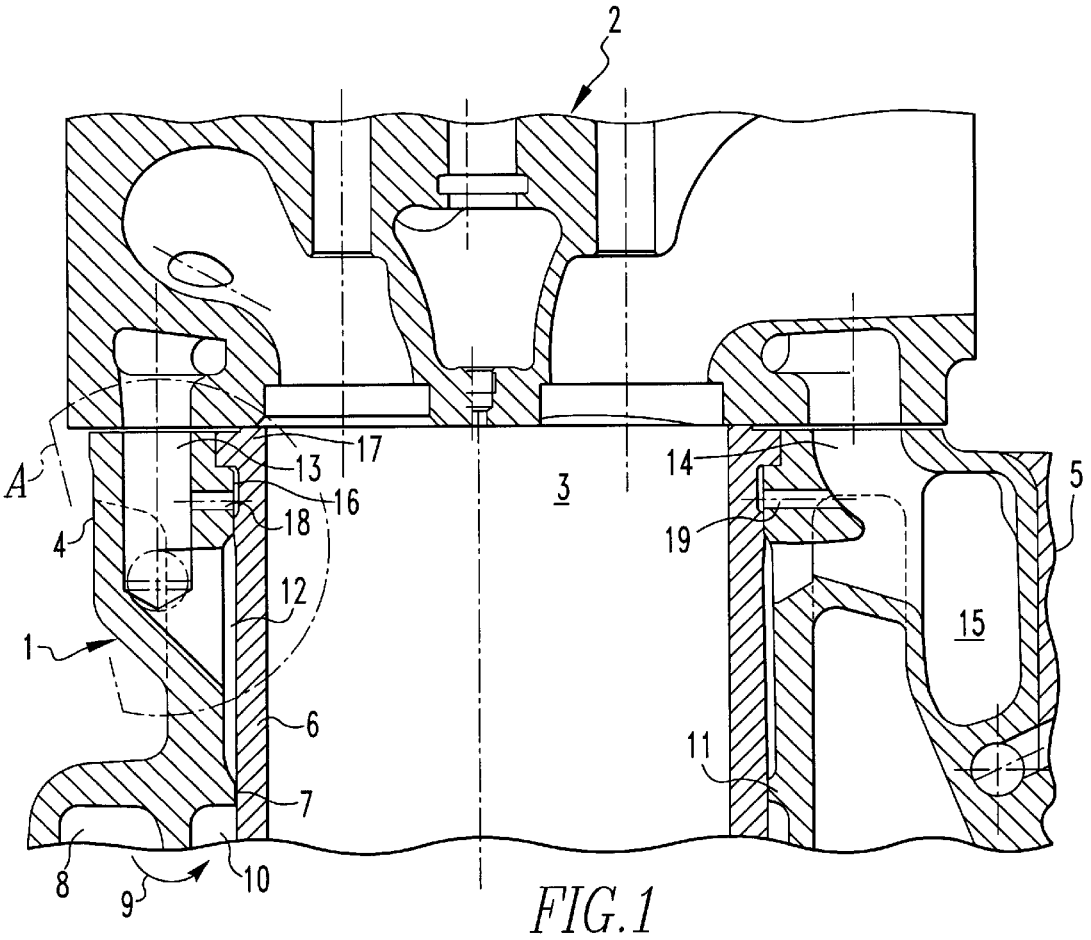
FIG. 1 is a cross-sectional view of the cylinder head area of a Diesel engine showing the invention in a simplified representation and with different cross-section orientation in order to facilitate the understanding of the invention.

FIG. 1 is a cross-sectional view of the cylinder head area of a cylinder of a Diesel engine represented in a simplified form, wherein the engine block is designated by the reference numeral 1 and the cylinder head is designated by the reference numeral 2. In order to limit the various features shown only to those needed for the understanding of the invention, the cross-section shown includes various cross-sectional planes.

The engine block 1 includes several cylinders 3, which are arranged in FIG. 1 behind one another. The engine block has longitudinal side walls 4 and 5, which extend normal to the cross-sectional plane as shown in FIG. 1. The engine block 1 includes cylinders 3 formed by cylinder sleeves 6 received in cylinder bores 7 of the engine block. Each cylinder sleeve 6 delimits, together with the cylinder bores 7, cooling water spaces of partially narrow cross-sections, the cooling water circuit according to the invention being explained herein specifically for the cross-sectional areas shown in the drawings.

The internal combustion engine is cooled by a forced flow cooling system, which includes a cooling water pump whose suction and discharge sides are connected to the cooling circuit which also includes a radiator or another heat discharge device. The discharge side of the cooling water pump is connected to a distribution passage 8, which is disposed adjacent the side wall 4 of the engine block. From the distribution passage 8 the cooling water enters an annular cooling zone 10 extending around a cylinder sleeve of each cylinder as indicated by the arrow 9. The cooling zone 10 is separated from another annular cooling zone 12 by an annular web 11, which includes recesses (not shown) forming communication passages between the cooling zone 10 and the cooling zone 12 through which the cooling water can flow from the cooling zone 10 to the cooling zone 12.

From the annular cooling zone 12, the cooling water, on its way back to the suction side of the cooling water pump, enters the supply passage 13 leading to the cylinder head 2. In the cylinder head 2, the cooling water flows through various passages, which are not shown, to a return passage 14, which guides the cooling water from the cylinder head 2 back to the engine block 1 and, in the engine block 1, leads to a return collection channel 15. The engine has individual cylinder heads (which is not apparent from the drawings) so that, in the longitudinal direction of the internal combustion engine, there are provided subsequent individual cylinder heads, each being in communication with the cooling circuit in the way as described with respect to FIG. 1.

Between the annular cooling water space forming the cooling zone 12, which extends around the axial center area of the cylinder sleeve 6, and the cylinder head 2, there is another annular channel 16 forming another cooling zone adjacent the annular shoulder 17 at the axial end of the cylinder sleeve 16 adjacent the cylinder head 2. The annular channel 16 surrounds the cylinder sleeve 6 circumferentially. It has a narrow cross-section and is formed by a groove cut into the cylinder sleeve 6 adjacent the shoulder 17. The outer circumference of the annular channel 16 is delimited by the wall of the cylinder bore 7 through which a radial bore 18 extends. The radial bore 18 provides for a communication path between the supply passage 13 and the annular channel 16, which is in communication with the pressure side of the cooling water circuit. About diagonally opposite the bore 18, there is provided a bore 19 which places the annular channel 16 in communication with the cooling water return passage 14 which leads to the collection channel 15 and to the suction side of cooling water pump.

The annular channel 16 is relatively narrow and high and extends axially from the shoulder 17 over an axial transition area of the cylinder bore 7 up to the cooling zone 12. In this way, the end area of the cylinder sleeve 6 at the top of the piston, when in its top dead center position, which is disposed adjacent the combustion chamber and which has particularly high thermal exposure, can be effectively cooled. For an adjustment of the cooling action, it is advantageous that the individual single cylinder heads have a relatively high but well defined cooling water flow resistance. The flows through the annular channels 16 which parallels the flow through the cylinder head can therefore be adapted to various circumstances depending on the respective cylinder of an internal combustion engine. The flow can be fine-adjusted without changing the geometry of the annular channels 16 simply by changing the cross-section of the radial supply and discharge bores 18 and 19. Normally, the bores 18 and 19 have about the same flow cross-section as the annular channel 16.

Figure 2:
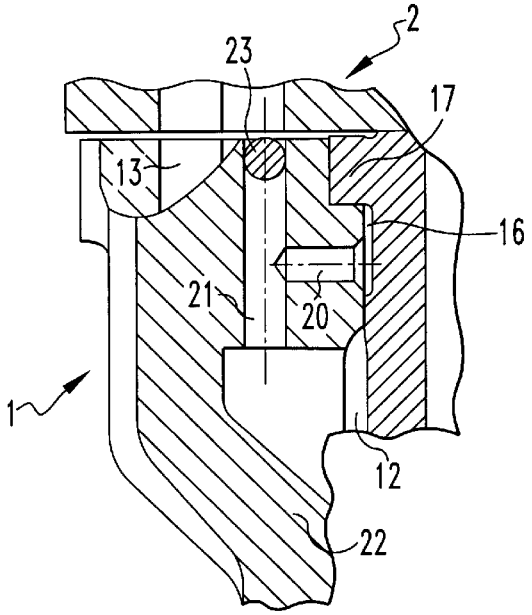
FIG. 2 is an enlarged cross-sectional view of the area marked in FIG. 1 by the dash dotted line A in a cross-sectional area different from that shown in FIG. 1 and showing an alternative embodiment for the coolant supply.

In FIG. 1, the supply bore 18 extends transversely to the supply passage 13 and branches off the supply passage 13. FIG. 2 shows an arrangement where the supply bore, which is indicated in this case by the numeral 20, extends to a dead end channel or rather bore 21 providing a direct communication path to a transition area 22 of the annular cooling zone 12. In this way an increased cooling water supply flow to the annular channel 16 can be achieved. FIG. 2 also shows that it may be advantageous in connection with the invention to widen the supply bore 20 (as well as the discharge bore which is not shown in FIG. 1) in the transition area to the annular channel 16, for example by a respective chamfer. The dead end bore 21 may be drilled into the engine block from the top surface thereof and then closed by pressing a ball 23 into the bore 21. Depending on the connection between the engine block 1 and the cylinder head 2, the bore 21 may also be closed at the top by the cylinder head gasket which however is not shown herein.

The arrangement according to the invention provides for a cooling system for an internal combustion engine wherein the cooling circuit extends upwardly along a cylinder sleeve and then through the cylinder head. From the cylinder head the cooling circuit extends back to a return collection channel 15, which, like the distribution passage 8, is arranged along a longitudinal side of the engine block opposite the side along which the distribution passage 8 extends. The uppermost cooling zone formed by the annular channel 16 is disposed in a parallel flow path with respect to the flow path through the cylinder head 2. Consequently, it forms a transverse flow path between the distribution passage 8 and the return collection channel 15—like the flow path through the cylinder head 2. All the other cooling zones of the engine block that is the annular cooling zones 10 and 12 between the engine block and the cylinder sleeves are arranged in a series flow arrangement with the flow path through the cylinder head and the parallel flow path through the uppermost annular channel 16.

What is claimed is:

1. A water-cooled internal combustion engine comprising a multi-cylinder engine block having longitudinal side walls, individual cylinder sleeves mounted in said engine block in side-by-side relationship, each having an annular shoulder at a top end thereof, a cylinder head mounted on said engine block individually for each cylinder, a cooling water distribution passage disposed at one side of said engine block for supplying cooling water to said cylinders, annular cooling zones extending around said cylinder sleeves and being in communication with said cooling water distribution passage, said engine block further including for each cylinder a cooling water supply passage extending from said annular cooling zones to said cylinder head for supplying cooling water thereto and a return passage in communication with a cooling water return collection channel extending along the other side of said engine block for conducting cooling water from said cylinder head and said annular cooling zones around said cylinder sleeves, each cylinder sleeve further including an annular cooling water passage formed adjacent said shoulder such that it is, at one side, in communication with the cooling water supply and, at another side in communication with the cooling water return collection channel so as to form a flow path around the top end of each cylinder sleeve in parallel with the flow path through the respective cylinder head.

2. A water-cooled internal combustion engine according to claim 1, wherein said cooling water supply and return passages are disposed opposite each other adjacent the opposite longitudinal sides of said engine block.

3. A water-cooled internal combustion engine according to claim 1, wherein said annular cooling water passage is connected to said supply passage for receiving cooling water therefrom.

4. A water-cooled internal combustion engine according to claim 1, wherein said annular cooling water passage is connected to said cooling water return passage.

5. A water-cooled internal combustion engine according to claim 1, wherein the cooling water supply to, and return from, said annular cooling water passage is formed by radial bores extending between the annular cooling water passage and the cooling water supply and the cooling water return passages respectively.

6. A water-cooled internal combustion engine according to claim 5, wherein said radial bores providing supply and return flow communications have about the same flow cross-section.

7. A water-cooled internal combustion engine according to claim 6, wherein the flow cross-section of said bores is at least as large as the flow cross-section of said annular cooling water passage.

8. A water-cooled internal combustion engine according to claim 7, wherein the flow cross-section of said bores is about twice as large as the flow cross-section of said annular cooling water passage.

* * * * *